US006550407B1

(12) United States Patent
Frost et al.

(10) Patent No.: US 6,550,407 B1
(45) Date of Patent: Apr. 22, 2003

(54) DOUBLE END SERVO SCROLL PATTERN ATTACHMENT FOR TUFTING MACHINE

(75) Inventors: Steven Frost, Signal Mountain, TN (US); Richard Prichard, Hixson, TN (US)

(73) Assignee: Tuftco Corporation, Chattanooga, TN (US)

( * ) Notice: Subject to any disclaimer, the term of this patent is extended or adjusted under 35 U.S.C. 154(b) by 0 days.

(21) Appl. No.: 10/227,376

(22) Filed: Aug. 23, 2002

(51) Int. Cl.[7] ..... D05C 15/18

(52) U.S. Cl. ..... 112/475.23; 112/80.73; 112/220

(58) Field of Search ..... 112/475.23, 80.73, 112/80.23, 80.01, 475.01, 220

(56) References Cited

U.S. PATENT DOCUMENTS

| | | | | |
|---|---|---|---|---|
| 2,862,465 | A | 12/1958 | Card | 112/80.24 |
| 2,966,866 | A | 1/1961 | Card | 112/80.73 |
| 3,067,701 | A | 12/1962 | Wilcox | 112/80.73 |
| 3,075,482 | A | 1/1963 | Card | 112/80.73 |
| 3,103,903 | A | 9/1963 | Broadrick et al. | 112/80.73 |
| 3,605,660 | A | 9/1971 | Short | 112/80.73 |
| 3,847,098 | A | 11/1974 | Hammel | 112/79 A |
| 3,906,876 | A | 9/1975 | Fitton | 112/79 A |
| 3,937,160 | A | 2/1976 | Spanel et al. | 112/80.07 |
| 4,127,078 | A | 11/1978 | Spanel et al. | 112/266 |
| 4,221,317 | A | 9/1980 | Fukuda | 112/80.73 |
| 4,244,309 | A | 1/1981 | Spanel et al. | 112/79 |
| 4,267,787 | A | 5/1981 | Fukuda | 112/266.2 |
| 4,285,285 | A | 8/1981 | Chambers et al. | 112/80.08 |
| 4,317,419 | A | 3/1982 | Spanel et al. | 112/475.23 |
| 4,366,761 | A | 1/1983 | Card | 112/80.41 |
| 4,469,037 | A | 9/1984 | Bost, Jr. | 112/80.23 X |
| 4,519,332 | A | 5/1985 | Fukuda | 112/266.2 |
| 4,549,496 | A | 10/1985 | Kile | 112/79.5 |
| 4,829,917 | A | 5/1989 | Morgante | 112/80.41 |
| 4,864,946 | A | 9/1989 | Watkins | 112/80.73 |
| 4,867,080 | A | 9/1989 | Taylor et al. | 112/80.32 |
| 4,870,915 | A | 10/1989 | Bagnall | 112/80.41 |
| 4,981,091 | A | 1/1991 | Taylor et al. | 112/80.23 |
| 5,005,498 | A | 4/1991 | Taylor et al. | 112/80.32 |
| 5,058,518 | A | 10/1991 | Card et al. | 112/266.2 |
| 5,094,178 | A | 3/1992 | Watkins | 112/80.73 |
| 5,105,750 | A | 4/1992 | Horie | 112/470.05 X |
| 5,182,997 | A | 2/1993 | Bardsley | 112/80.73 |
| 5,383,415 | A | 1/1995 | Padgett | 112/266.2 |
| 5,458,075 | A | 10/1995 | Tice et al. | 112/470.06 X |
| 5,544,605 | A | 8/1996 | Frost | 112/475.23 |
| 5,549,064 | A | 8/1996 | Padgett | 112/410 |
| 5,588,383 | A | 12/1996 | Davis et al. | 112/80.6 |
| 6,213,036 | B1 | 4/2001 | Slattery | 112/80.73 |
| 6,244,203 | B1 | 6/2001 | Morgante et al. | 112/475.23 |
| 6,283,053 | B1 | 9/2001 | Morgante et al. | 112/80.73 |
| 6,439,141 | B2 * | 8/2002 | Morgante et al. | 112/80.73 |
| 6,502,521 | B2 * | 1/2003 | Morgante et al. | 112/80.73 X |

FOREIGN PATENT DOCUMENTS

| | | | |
|---|---|---|---|
| GB | 1126549 | 9/1968 | D05C/15/32 |
| GB | 1363974 | 8/1974 | D05C/15/04 |
| GB | 2002828 | 2/1979 | D05C/15/32 |

OTHER PUBLICATIONS

Autumn, 1987 Carpet Manufacturer International ITMA 87 Preview.
Carpet and Rugs, Dec., 1987 Automation Comes to Paris.
Ziesness German Multiplex Tufting Machine Brochure.
Ziesness Operational Manual.

(List continued on next page.)

*Primary Examiner*—Peter Nerbun
(74) *Attorney, Agent, or Firm*—Douglas T. Johnson

(57) ABSTRACT

The present invention provides a double end yarn drive pattern attachment for tufting machines characterized by independent servo-motor control of yarn feed rolls capable of increased torque to carry multiple yarn ends on a single feed roll, thereby economically retaining many advantages of a single end pattern attachment.

20 Claims, 5 Drawing Sheets

OTHER PUBLICATIONS

Tuftco Encore DMC brochure.

Tuftco Encore Yarn Feed Control brochure.

Tuftco Encore Computer Controlled Tufting on Management Information System Brochure.

Tuftco Patterns of Imagination Brochure.

CMC CP–2100 series Yarn Feed Shift Compensation System Brochure.

Mechanical Development in Tufting Machinery by Max M. Beasley, 1966.

LPIII Low Profuile Scroll by Cobble, 1985/1986.

Cobble Tufting Machines L.P. Scroll, 1985/1986.

* cited by examiner

| ROLL | NEEDLE | STITCH HEIGHT | | | | | | | | | |
|---|---|---|---|---|---|---|---|---|---|---|---|
| A | 1 | H | H | M | M | L | L | M | M | H | H |
| A | 2 | H | H | M | M | L | L | M | M | H | H |
| B | 3 | H | M | M | L | L | M | M | H | H | M |
| B | 4 | H | M | M | L | L | M | M | H | H | M |
| C | 5 | M | M | L | L | M | M | H | H | M | M |
| C | 6 | M | M | L | L | M | M | H | H | M | M |
| D | 7 | M | L | L | M | M | H | H | M | M | L |
| D | 8 | M | L | L | M | M | H | H | M | M | L |
| E | 9 | L | L | M | M | H | H | M | M | L | L |
| E | 10 | L | L | M | M | H | H | M | M | L | L |

Fig. 6A

| ROLL | NEEDLE | TUFT APPEARANCE | | | | | | | | | |
|---|---|---|---|---|---|---|---|---|---|---|---|
| A | 1 | **O** | **O** | O | O | o | o | O | O | **O** | **O** |
| A | 2 | **O** | **O** | O | O | o | o | O | O | **O** | **O** |
| B | 3 | **O** | O | O | o | o | O | O | **O** | **O** | O |
| B | 4 | **O** | O | O | o | o | O | O | **O** | **O** | O |
| C | 5 | O | O | o | o | O | O | **O** | **O** | O | O |
| C | 6 | O | O | o | o | O | O | **O** | **O** | O | O |
| D | 7 | O | o | o | O | O | **O** | **O** | O | O | o |
| D | 8 | O | o | o | O | O | **O** | **O** | O | O | o |
| E | 9 | o | o | O | O | **O** | **O** | O | O | o | o |
| E | 10 | o | o | O | O | **O** | **O** | O | O | o | o |

Fig. 6B

DOUBLE END SERVO SCROLL PATTERN ATTACHMENT FOR TUFTING MACHINE

BACKGROUND OF THE INVENTION

This invention relates to a yarn feed mechanism for a tufting machine and more particularly to a scroll-type pattern controlled yarn feed where about two to five yarns may be wound on a separate yarn feed roll, and each yarn feed roll is driven by an independently controlled servo motor.

Pattern control yarn feed mechanisms for multiple needle tufting machines are well known in the art and may be generally characterized as either roll-type or scroll-type pattern attachments. Roll type attachments are typified by J. L. Card, U.S. Pat. No. 2,966,866 which disclosed a bank of four pairs of yarn feed rolls, each of which is selectively driven at a high speed or a low speed by the pattern control mechanism. All of the yarn feed rolls extend transversely the entire width of the tufting machine and are journaled at both ends. There are many limitations on roll-type pattern devices. Perhaps the most significant limitations are: (1) as a practical matter, there is not room on a tufting machine for more than about eight pairs of yarn feed rolls; (2) the yarn feed rolls can be driven at only one of two, or possibly three speeds, when the traditional construction utilizing clutches is used—a wider selection of speeds is possible when using direct servo motor control, but powerful motors and high gear ratios are required and the shear mass involved makes quick stitch by stitch adjustments difficult; and (3) the threading and unthreading of the respective yarn feed rolls is very time consuming as yarns must be fed between the yarn feed rolls and cannot simply be slipped over the end of the rolls, although the split roll configuration of Watkins, U.S. Pat. No. 4,864,946 addresses this last problem.

Scroll-type pattern attachments are disclosed in J. L. Card, U.S. Pat. No. 2,862,465, and are shown projecting transversely to the row of needles, although subsequent designs have been developed with the yarn feed rolls parallel to the row of needles as in Hammel, U.S. Pat. No. 3,847,098. Typical of scroll type attachments is the use of a tube bank to guide yarns from the yarn feed rolls on which they are threaded to the appropriate needle. In this fashion yarn feed rolls need not extend transversely across the entire width of the tufting machine and it is physically possible to mount many more yarn feed rolls across the machine. Typically, scroll pattern attachments have between 36 and 120 sets of rolls, and by use of electrically operated clutches each set of rolls can select from two, or possibly three, different speeds for each stitch. The use of yarn feed tubes introduces additional complexity and expense in the manufacture of the tufting machine; however, the greater problem is posed by the differing distances that yarns must travel through yarn feed tubes to their respective needles. Yarns passing through relatively longer tubes to relatively more distant needles suffer increased drag resistance and are not as responsive to changes in the yarn feed rates as yarns passing through relatively shorter tubes. Accordingly, in manufacturing tube banks, compromises have to be made between minimizing overall yarn drag by using the shortest tubes possible, and minimizing yarn feed differentials by utilizing the longest tube required for any single yarn for every yarn. Tube banks, however well designed, introduce significant additional cost in the manufacture of scroll-type pattern attachments.

One solution to the tube bank problems, which also provides the ability to tuft full width patterns is the full repeat scroll invention of Bradsley, U.S. Pat. No. 5,182,997, which utilizes rocker bars to press yarns against or remove yarns from contact with yarn feed rolls that are moving at predetermined speeds. Yarns can be engaged with feed rolls moving at one of two preselected speeds, and while transitioning between rolls, yarns are briefly left disengaged, causing those yarns to be slightly underfed for the next stitch.

Another significant limitation of scroll-type pattern attachments is that each pair of yarn feed rolls is mounted on the same set of drive shafts so that for each stitch, yarns can only be driven at a speed corresponding to one of those shafts depending upon which electromagnetic clutch is activated. Accordingly, it has not proven possible to provide more than two, or possibly three, stitch heights for any given stitch of a needle bar.

As the use of servo motors to power yarn feed pattern devices has evolved, it has become well known that it is desirable to use many different stitch lengths in a single pattern. Prior to the use of servo motors, yarn feed pattern devices were powered by chains or other mechanical linkage with the main drive shaft and only two or three stitch heights, in predetermined ratios to the revolutions of the main drive shaft, could be utilized in an entire pattern. With the advent of servo motors, the drive shafts of yarn feed pattern devices may be driven at almost any selected speed for a particular stitch.

Thus a servo motor driven pattern device might run a high speed drive shaft to feed yarn at 0.9 inches per stitch if the needle bar does not shift, 1.0 inches if the needle bar shifts one gauge unit, and 1.1 inches if the needle bar shifts two gauge units. Other slight variations in yarn feed amounts are also desirable, for instance, when a yarn has been sewing low stitches and it is next to sew a high stitch, the yarn needs to be slightly overfed so that the high stitch will reach the full height of subsequent high stitches. Similarly, when a yarn has been sewing high stitches and it is next to sew a low stitch, the yarn needs to be slightly underfed so that the low stitch will be as low as the subsequent low stitches. Therefore, there is a need to provide a pattern control yarn feed device capable of producing scroll-type patterns and of feeding the yarns from each yarn feed roll at an individualized rate.

Commonly assigned U.S. Pat. No. 6,224,203, invented by Morgante et. al., incorporated herein by reference, addressed many of these concerns by creating a single-end servo attachment. This servo-scroll attachment allowed each end of yarn across the entire width of a full-size tufting machine to be independently controlled. By providing each end of yarn with an independently driven yarn feed roll, the use of the tube bank was eliminated, while allowing the creation of patterns that do not repeat across the entire width of a broadloom tufting machine. Despite the advances associated with a single-end servo scroll attachments, the cost of the single end attachment makes its use for generic or commodity carpeting financially disadvantageous. In addition, for tufting at high speeds with bulky yarns, it is desirable to have more torque than is provided by the relatively small servo motors that can be positioned on the single-end servo attachment.

SUMMARY OF THE INVENTION

It is therefore an object of this invention to provide in a multiple needle tufting machine a pattern controlled yarn feed mechanism incorporating a plurality of individually driven yarn feed rolls carrying at least two yarn ends.

The yarn feed mechanism made in accordance with this invention includes a plurality of yarn feed rolls, each being directly driven by a servo motor up to approximately twenty yarn feed rolls with attached servo motors, may be mounted upon an arched mounting arm which is attached to the tufting machine. A plurality of mounting arms extend across the tufting machine. Each yarn feed roll is driven at a speed dictated by its corresponding servo motor and each servo motor can be individually controlled.

It is a further object of this invention to provide a pattern controlled yarn feed mechanism with many of the benefits of a single-end motor driven yarn feed attachment at reduced cost.

It is yet another object of the invention to provide additional torque for the rotation of the yarn feed rolls, without using unnecessarily large servo motors.

BRIEF DESCRIPTION OF THE DRAWINGS

FIGS. 6A and 6B illustrate the tufting pattern dictated by double-end servo scroll attachments showing identical tufting heights for each needle pair fed by a given servo motor.

DETAILED DESCRIPTION OF THE INVENTION

Figure 1:
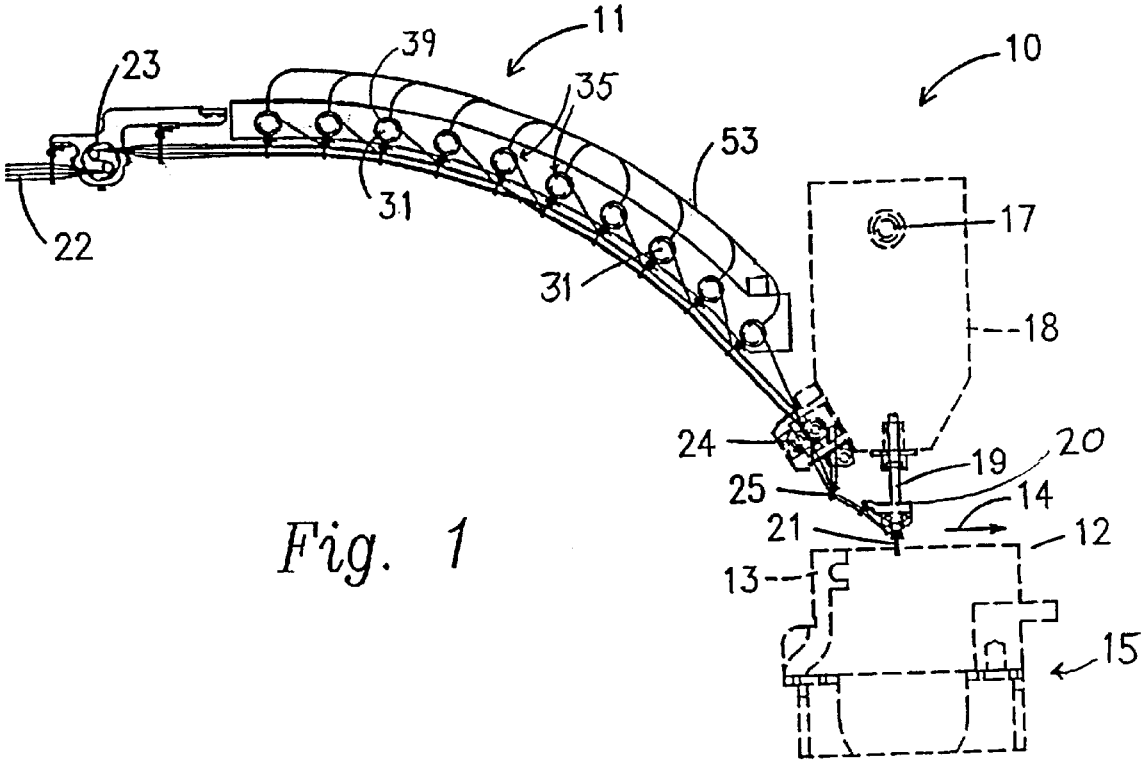
FIG. 1 is a side elevation view of the multiple-needle tufting machine incorporating an embodiment the double-end pattern control yarn feed mechanism made in accordance with the invention.

Referring to the drawings in more detail, FIG. 1 discloses a multiple needle tufting machine 10 upon the front of which is mounted a pattern control yarn feed attachment 11 in accordance with this invention. It will be understood that it is possible to mount pattern control yarn feed attachments 11 on both sides of a tufting machine 10 when desired. The machine 10 includes a housing 12 and a bed frame 13 upon which is mounted a needle plate, not shown, for supporting a base fabric adapted to be moved through the machine 10 from front to rear in the direction of the arrow 14 by front and rear fabric rollers. The bed frame 13 is in turn mounted on the base 15 of the tufting machine 10.

A main drive motor drives a rotary main drive shaft 17 mounted in the head 18 of the tufting machine. Drive shaft 17 in turn causes push rods 19 to move reciprocally toward and away from the base fabric. This causes needle bar 20 to move in a similar fashion. Needle bar 20 supports a plurality of preferably uniformly spaced needles 21 aligned transversely to the fabric feed direction 14.

In operation, yarns 22 are fed through tension bars 23, into the pattern control yarn feed device 11. After exiting the yarn feed device 11, yarns 22 are guided in a conventional manner through yarn puller rollers 24, and yarn guides 25 to needles 21. A looper mechanism, not shown, in the base 15 of the machine 10 acts in synchronized cooperation with the needles 21 to seize loops of yarn 22 and form cut or loop pile tufts, or both, on the bottom surface of the base fabric in well known fashions.

In order to form a variety of yarn pile heights, a pattern controlled yarn feed mechanism 11 incorporating a plurality of yarn feed rolls adapted to be independently driven at different speeds has been designed for attachment between the tensioning bars 23 and the yarn puller rollers 24.

Figure 2:
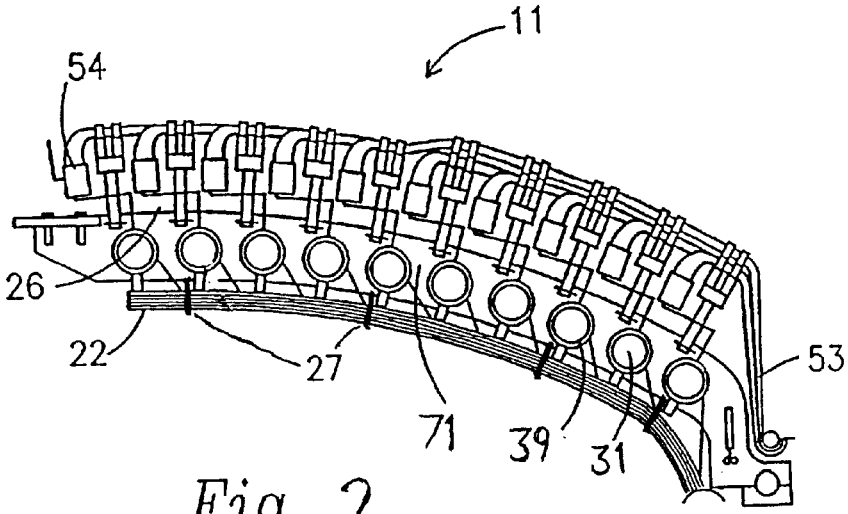
FIG. 2 is a side elevation view of a similar embodiment of an arched support for a pattern control yarn feed mechanism according to the invention, shown in isolation.
Figure 3:
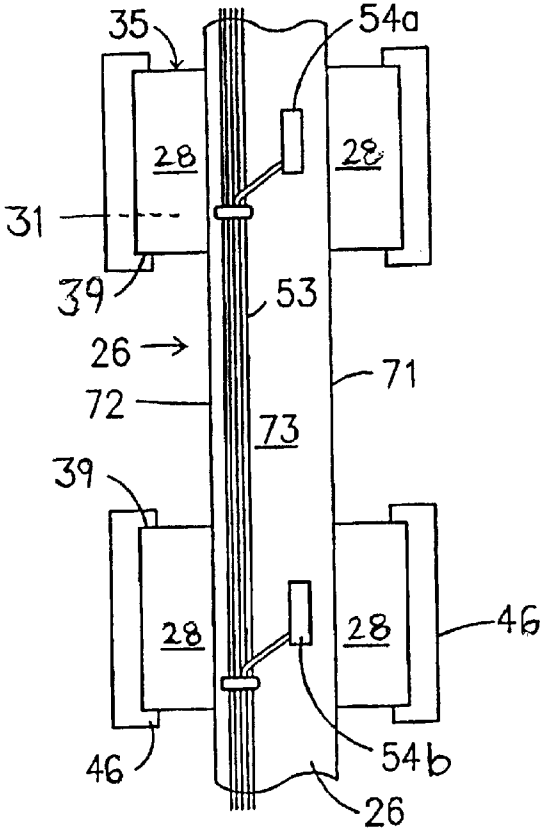
FIG. 3 is a top elevation view of a segment of a support bar with four servo driven yarn feed rolls, two on each side.

As best disclosed in FIGS. 1 and 2, an array of yarn drives 35 is assembled on an arching support bar 26 extending across the front of the tufting machine 10 and providing opposing vertical mounting surfaces 71, 72 on each of its sides and an upward facing top surface 73 (shown in FIG. 3). On the opposing side-facing surfaces 71, 72 are preferably mounted a total of twenty servo motors 31 and driven yarn feed rolls 39, ten on each side, shown in isolation in FIG. 3. It will be understood that the number of rolls on each support bar 26 may be varied for many reasons, especially in proportion to the gauge of the needles 21 on the needle bar 20. For instance, in the case of ⅛ gauge needle spacing (8 needles per inch) and support bars spaced every three inches, it would be desirable to carry twelve independently driven double end yarn feed rolls on each support bar 26. In practice, the support bars 26 should carry at least about six, and preferably at least about twelve, double end servo driven yarn feed rolls 39. Typically, each support bar 26 will carry a complement of twenty servo motor driven yarn feed rolls 39, and the spacing of the support bars will be adjusted to suit the needle gauge.

Figure 4:
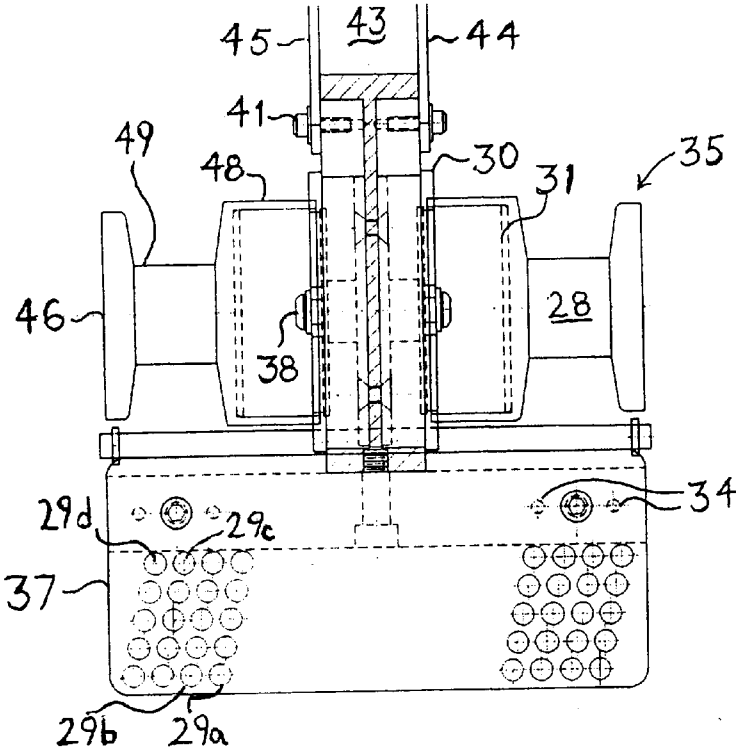
FIG. 4 is a rear elevation view of a section of a support holding two stepped down yarn feed rolls, two servo motors that control yarn feed roll rotation, and a yarn guide plate.

As shown in FIG. 1 and in detail in FIG. 3, the arching support bar 26 accommodates the wiring bundle 53 from the motors via the wiring path 43, shown in FIG. 4, built into the arching support bar 26, which facilitates the wiring of the motors. Wiring plugs 54*a* and 54*b* join the wiring bundle 53 to leads connected to the motors 31 and allow for easy servicing. Wiring bundle 53 is in turn connected to servo motor controller board, which may be in a central cabinet or installed on an arching support 26.

Each double end yarn drive 35 consists of a yarn feed roll 39 and a servo motor 31. In one embodiment, the servo motor 31 directly drives the yarn feed roll 39, which may be advantageously attached concentrically about the servo motor 31, as shown in FIG. 3. Preferably a yarn 22 is directed by yarn guide plates 27 and other conventional designs so that the yarn wrapped around nearly 180° of the circumference of the yarn feeding surface 28 of the yarn feed roll, and at least about 135° of said circumference. As shown in FIG. 4, yarn guide posts 34 may protrude from the yarn guide plates 27 in the general direction of the yarn feed, and help ensure the proper placement of two or more yarns 22 on yarn feed rolls 39.

It will also be noted in FIGS. 2 and 4 that yarns 22 from the yarn supply are fed through apertures 29 on the support yarn guides 27, 37. Specifically, a pair of yarns 22 for a yarn feed drive 35 on the support 26 distal from the tufting machine are fed through apertures 29*a*, 29*b* near the bottom of guides 37 until the yarns reach their associated yarn drive 35, and are fed around approximately 180° of the yarn feed roll 39 on its associated yarn drive 35, and those yarns then continue through lower apertures 29*a*, 29*b* of the remaining support yarn guides 37. Because two ends of yarn are wrapped around each of the ten yarn feed rolls 28 on one side of the attachment 11, twenty apertures 29 are required on each of the left and right sides of the yarn guide plate 37 to accommodate the yarns. Yarns 22 being wrapped and driven by a contacting yarn feed roll 39 distal from the tufting machine 10 enter the apertures 29*a*, 29*b* with each of the two yarns to a particular yarn feed roll 39 threaded through adjacent apertures. For example apertures 29*a* and 29*b* could have yarns driven by the same yarn feed roll 39. Yarns from a yarn feed roll 39 quite proximal to the tufting machine 11 would occupy apertures 29*c* and 29*d*. The apertures 29 are arranged in parallel, diagonally offset rows. The arrangement allows all the yarn ends for each of the yarn feed rolls 39 to be directed through the attachment 11 to the proper needles without introducing unwanted friction between individual yarns.

It will also be seen in FIG. 4 that the servo motors 31 are advantageously set on base plates 30 of greater diameter than the yarn feed rolls 39, which permits the base plate 30 and attached motors 31 to be mounted on the support bar 26 with several motor mount bolts 38. Additional fasterns 41 are used to secure covers 44, 45 or circuit board assemblies over support 26, thereby defining wiring path 43.

Each feed roll 39 has a yarn feeding surface 28 formed of a sand-paper like or other high friction material upon which the yarns are fed. As shown in FIG. 3 end caps 46 help ensure the yarns 22 remain on the feeding surface 28, and may protect motors 31 from dust or other contamination. Each of the yarn feed rolls 39 may be loaded with two yarns, which is a light load providing little resistance compared to the hundred or more yarns that might be carried on a roll-type yarn feed attachment, the hundreds of individual yarns typically driven by a single scroll drive shaft, or even the dozen yarns typically driven in the commonly assigned servo-scroll patent, U.S. Pat. No. 6,244,203. Because of the lighter loads involved in feeding only a very few yarns, the present design permits the use of small servo motors that can mount inside or outside of the yarn feed rolls 39. For instance, a typical motor for a double end yarn would be a 24–28 volt motor using 3 amps of power. This motor would be able to generate 5 lb-in of torque at 3 amps, having a maximum no load speed of 650 RPM. A representative motor of this type is the Full Repeat Scroll Motor by Moog, Inc. (C22944), which meets these general specifications. A motor of this type is sufficiently powerful to turn the associated yarn feed roll without the need for any gearing advantage in most situations. Thus the preferred ratio of servo motor revolutions to yarn feed roll revolutions is 1:1.

However, in some applications, especially utilizing heavy and irregular yarns with frequent low stitch height to high stitch height yarn feed changes, additional torque may be preferred, whether a single or several yarns are being driven. Accordingly, modified yarn feed rolls 49 are shown in FIG. 4. These yarn feed rolls 49 have a mounting section 48 that fits over and engages servo motors 31, a stepped down diameter yarn feeding surface 28, and an end cap portion 46. The associated yarn guide plate 37 is also modified to a wider structure than that used with conventional yarn feed rolls 39, shown in FIG. 3, so that the apertures 29 for feeding yarns are generally aligned beneath the yarn feeding surfaces 28. By reducing the diameter of the yarn feed surface portion 28 of the yarn feed rolls, a single revolution of servo motor 31 feeds less yarn, effectively reducing the maximum yarn feed rate and increasing the torque of the yarn feed drive 35.

In commercial operation, it is anticipated that a typical two meter, rug size tufting machine will utilize pattern controlled yarn feed devices 11 according to the embodiments of FIGS. 1–4 with approximately fourteen support bars 26, each bar bearing twenty yarn feed drives 35 thereby providing about 280 independently controlled yarn feed rolls 28. This provides the capacity to feed 560 yarns in the double end drive configuration, without the necessity of a tube bank. If any yarn feed roll 39 or associated servo motor 31 should become damaged or malfunction, the arched support bar 26 can be pivoted downward for ease of access. A replacement yarn drive 35 already fitted with a yarn feed roll 39 or 49 and a servo motor 31 can be quickly installed. This allows the tufting machine to resume operation while repairs to the damaged or malfunctioning yarn feed rolls and motor are completed, thereby minimizing machine down time.

In a typical configuration, the double end yarn drives 11 are longitudinally spaced at about four to seven inch intervals along the support bar. This spacing is necessary to ensure proper yarn travel and minimal yarn resistance and stretching while still allowing enough space between the yarn feed rolls 39 or 49 to allow minor adjustments. The distance between support bar centers carrying double end drives 35 is typically about six to eight inches but may vary. This variability is necessary because of differences in the needle gauge that may be used. For instance, a larger needle gauge will require the needles to be spread at further intervals allowing more space between the support bars. However, for smaller needle gauges, the support arms will need to be closer together due to the increased proximity of the needles. As a result of the greater spacing between support bars in this embodiment in comparison to the single end drives of U.S. Pat. No. 6,283,053, yarn spreaders may be used to disperse the yarns from pattern attachment 11 to the yarn puller rollers 24 and guides 25.

Figure 5A:
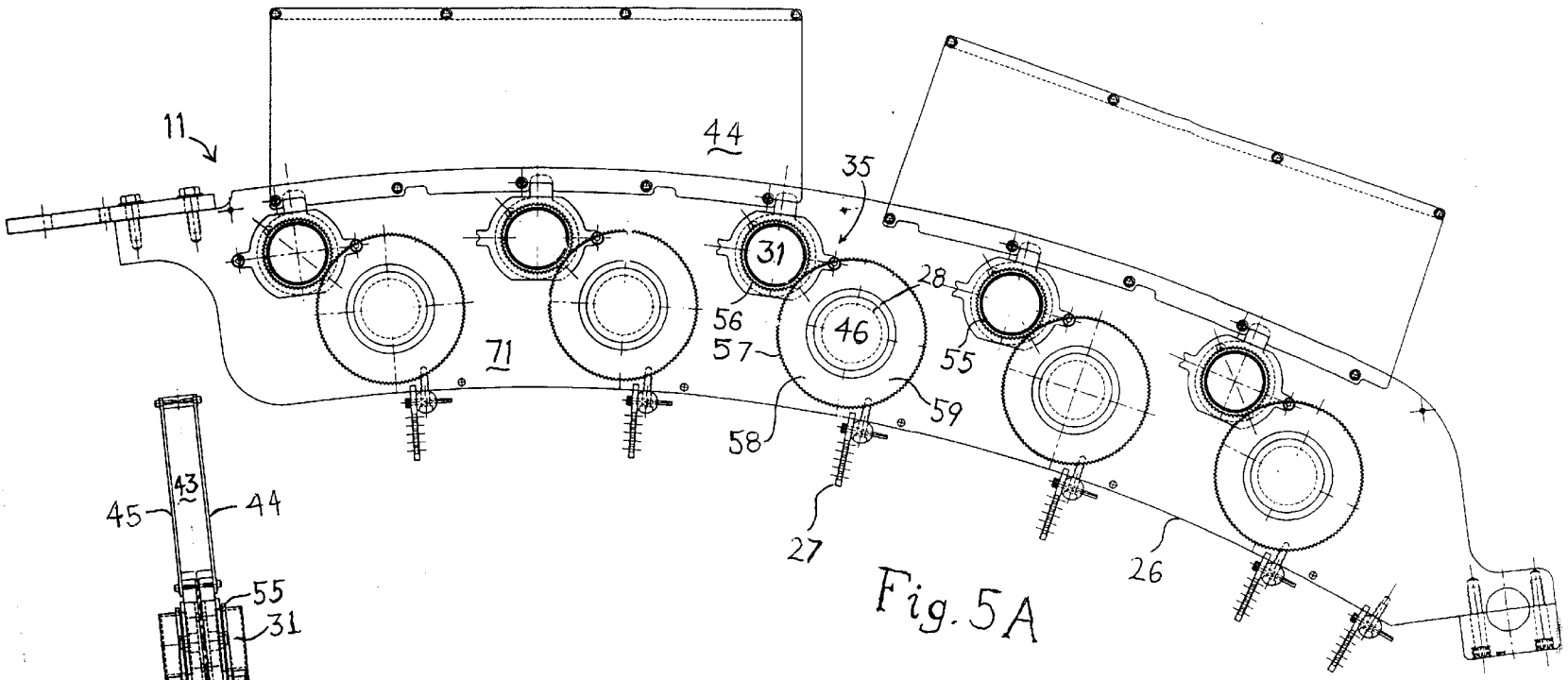
FIG. 5A is a side elevation view of a double-end pattern control yarn feed mechanism utilizing a geared drive system.
Figure 5B:
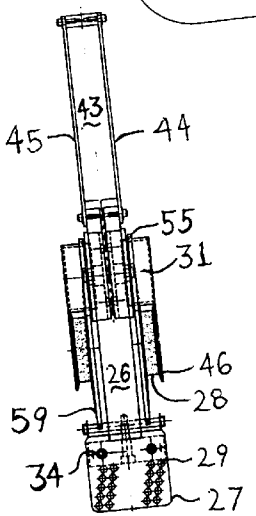
FIG. 5B is a rear elevation view of the invention of FIG. 5A, taken along a section of the support bar and showing two yarn drives and a yarn guide plate.

FIGS. 5A and 5B illustrates an alternative preferred embodiment of a double end servo yarn feed pattern attachment 11. In this embodiment, only about five servo motors 31 are mounted on each of the opposed surfaces 71, 72 of support bar 26. The greater longitudinal spacing between servo motors 31, now on the order of about eight to fifteen inches, permits the mounting of geared yarn feed rolls 59. On servo motors 31 is mounted a drive gear 55, having gear teeth 56 that mesh with teeth 57 of yarn feed roll 59. The overall diameter of the servo motor 31 is only about three inches, and the drive gear 55 adds little additional diameter. The overall diameter of the teethed section 58 of the geared yarn drive roll 59 may be between about six to nine inches. The diameter of the yarn feeding surface portion 28 on rolls 59 remains at about three inches. Thus, it now requires two or three revolutions of servo motors 31 to feed the same lengths of yarn that would have been fed by a single servo motor revolution in the embodiment of FIG. 3. The result is that the maximum yarn feed rate has been diminished and the effective torque of yarn feed drives 35 has been increased by a factor of about two or three. Unlike the extended yarn feed rolls 49 of FIG. 4, the geared rolls do not require additional lateral spacing between support bars, and about twenty-five to thirty such support bars 26 might be placed on a two meter tufting machine, with as little as 3¼ inch spacing between bar centers. Because the support bars 26 as illustrated in FIG. 5 are spaced just as single end drive support bars, no changes are necessary to spread the yarns 22 as they exit the pattern attachment 11 and proceed to the yarn puller rollers 24, guides 25 and needles 21.

It will be understood that the geared portion 56 of drive gear 55 and the teethed section 58 of geared yarn feed roll 59, are adjacent to the support bar 26, so as not to interfere with placement of yarns over end cap 46 and on the yarn feeding surfaces 28. This embodiment provides the enhanced torque desired for feeding a plurality of yarns, however, it does introduce a linkage between the general wheels 55, 59, and a slight loss in yarn feed precision in comparison to a direct yarn drive.

FIGS. 6A and 6B illustrate the resolution characteristics of a simple carpet pattern manufactured with five double end yarn drives. Each of the yarn feed rolls A–E sends two yarn ends to adjacent needles. The yarns can be tufted with a plurality of heights, but for the sake of clarity stitch heights have been restricted to High (H), Medium (M), and Low (L). The use of double end drives restricts yarns on needle pairs 1–2, 3–4, 5–6, 7–8 and 9–10 to the same stitch height, creating double stitch groupings. In practical terms the finest resolution achievable with a double end yarn feed attachment is limited to the width of two contiguous needles. However, the stitch density is not affected. In other words fabrics with the same number of stitches per inch are produced as in products manufactured using single end yarn drives. The double end yarn drives can change stitch heights for a pair of needles just as stitch heights are changed for a single needle in a single end yarn drive. However, because both adjacent needles fed by a double end yarn drive must change to the same stitch height resulting in less definition on the finished fabric. The result is a patterned fabric having conventional stitch density, a wide range of variances in stitch height, but only half the resolution of single end yarn feed designs. A double end drive attachment permits tufting of fabrics with only half the yarn drives of a single end attachment without sacrificing any stitch count in the fabric. Double end attachments are therefore cheaper to manufacture, easier to maintain, and allow high resolution tufting to enter lower margin tufting markets. With appropriate modifications in the yarn guides 27, 37, triple end and even quadruple end yarn feed attachments are also practicable, with a corresponding further loss in pattern definition. It must also be noted that the pattern design software used for tufting machines equipped with single end yarn feed attachments must be slightly modified for use with double end yarn feed attachments. Specifically, the software must be altered to require the stitches of paired needles to always be at the same heights.

Figure 7:
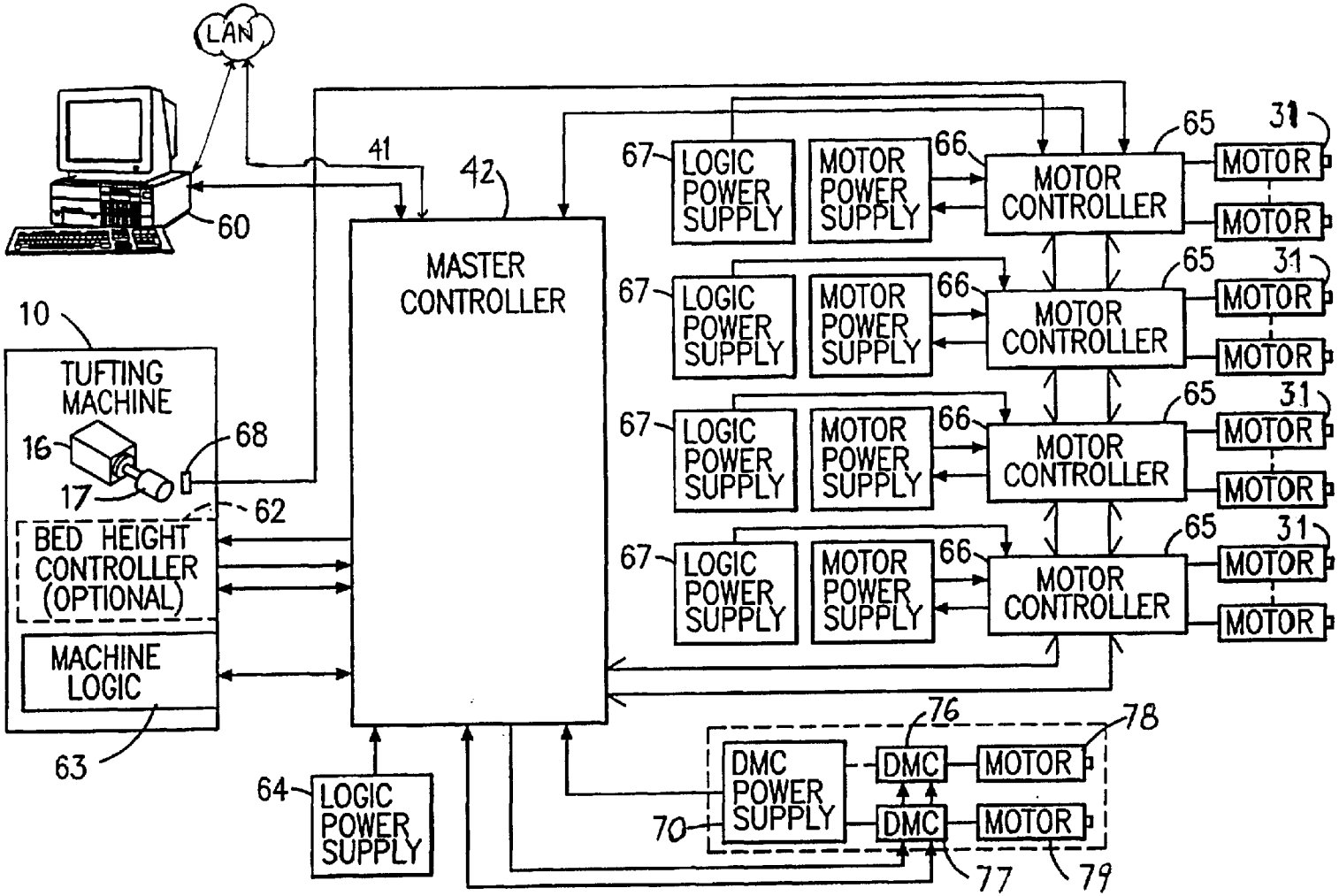
FIG. 7 is a schematic view of the electrical flow diagram for a multiple needle tufting machine incorporating a yarn feed mechanism made in accordance with the present invention.

Turning now to FIG. 7, a general electrical diagram of the invention is shown in the context of a computerized tufting machine with main drive motor 19 and drive shaft 17. A personal computer 60 is provided as a user interface, and this computer 60 may also be used to create, modify, display and install patterns in the tufting machine 10 by communication with the tufting machine master controller 42.

Due to the very complex patterns that can be tufted when individually controlling each end of yarn, many patterns will comprise large data files that are advantageously loaded to the master controller by a network connection 61; and preferably a high bandwidth network connection.

Master controller 42 preferably interfaces with machine logic 63, so that various operational interlocks will be activated if, for instance, the controller 42 is signaled that the tufting machine 10 is turned off, or if the "jog" button is depressed to incrementally move the needle bar, or a housing panel is open, or the like. Master controller 42 may also interface with a bed height controller 62 on the tufting machine to automatically effect changes in the bed height when patterns are changed. Master controller 42 also receives information from encoder 68 relative to the position of the main drive shaft 17 and preferably sends pattern commands to and receives status information from controllers 76, 77 for backing tension motor 78 and backing feed motor 79 respectively, Said motors 78,79 are powered by power supply 70. Finally, master controller 42, for the purposes of the present invention, sends ratiometric pattern information to the servo motor controller boards 65. The master controller 42 will signal particular servo motor controller board 65 that it needs to spin its particular servo motors 31 at given revolutions for the next revolution of the main drive shaft 17 in order to control the pattern design. The servo motors 31 in turn provide positional control information to their servo motor controller board 65 thus allowing two-way processing of positional information. Power supplies 67, 66 are associated with each servo motor controller board 65 and motor 31.

Master controller 42 also receives information relative to the position of the main drive shaft 17. Servo motor controller boards 65 process the ratiometric information and main drive shaft positional information from master controller 42 to direct servo motors 31 to rotate yarn feed rolls 28 the distance required to feed the appropriate yarn amount for each stitch.

While preferred embodiments of the invention have been described above, it is to be understood that any and all equivalent realizations of the present invention are included within the scope and spirit thereof. Thus, the embodiments depicted are presented by way of example only and are not intended as limitations upon the present invention. While particular embodiments of the invention have been described and shown, it will be understood by those skilled in the art that the present invention is not limited thereto since many modifications can be made. Therefore, it is contemplated that any and all such embodiments are included in the present invention as may fall within the scope or equivalent scope of the appended claims.

We claim:

1. In a multiple needle tufting machine adapted to feed a backing fabric longitudinally from front to rear through the machine having a plurality of spaced needles aligned transversely of the machine for reciprocal movement through the backing fabric by operation of a rotary main drive shaft, a yarn feed mechanism comprising:

(a) a support having a mounting surface extending longitudinally away from the tufting machine;

(b) at least about five servo motors, longitudinally spaced and attached to the mounting surface, wherein each servo motor is in communication with a yarn feed roll;

(c) a controller which electronically receives rotational position information for the main drive shaft and electronically sends corresponding ratiometric pattern information to the servo motors; and (d) at least about five pluralities of yarns proceeding from a yarn supply through the yarn feed mechanism to the plurality of spaced needles, such that each of the pluralities of yarns is fed by a yarn feed roll in communication with a distinct servo motor, and every yarn within each plurality of yarns is fed to an adjacent needle.

2. The yarn feed mechanism of claim 2 wherein said yarn feed mechanism comprises approximately twenty servo motors and associated yarn feed rolls attached to said support bar.

3. The yarn feed mechanism of claim 1 wherein the support is arched.

4. The yarn feed mechanism of claim 1 wherein the pluralities of yarns consist of two yarns.

5. The yarn feed mechanism of claim 1 wherein the pluralities of yarns comprise no more than five yarns.

6. The yarn feed mechanism of claim 1 wherein at least about ten support bars are aligned transversely on the tufting machine.

7. The yarn feed mechanism of claim 1 wherein the yarn feed roll can be rotated at any one of at least twenty speeds by communication with the servo motor.

8. The yarn feed mechanism of claim 1 wherein the yarn feed rolls in communication with each servo motor have a portion mounted concentrically about and connected directly to the servo motor.

9. The yarn feed mechanism of claim 8 wherein the yarn feed rolls have a yarn feeding surface portion having a smaller diameter than the portion mounted concentrically about the servo motor.

10. The yarn feed mechanism of claim 1 wherein each servo motor communicates with the yarn feed roll by driving a gear of relatively small diameter which communicates with a gear of relatively large diameter on the yarn feed roll.

11. The yarn feed mechanism of claim 10 wherein the torque of each servo motor is less than the torque of the yarn feed roll that the servo motor communicates with.

12. The yarn feed mechanism of claim 10 wherein each of the servo motors operate with less than ten pounds per inch of torque.

13. The yarn guide mechanism of claim 1 having a plurality of yarn guide plates with apertures arranged in offset parallel rows.

14. A method of tufting a carpet by feeding a backing fabric through a tufting machine of the type having a plurality of spaced needles aligned to form a row transverse to the machine for reciprocal movement through the backing fabric, a yarn supply, and a yarn feed mechanism having between about one-half and one-fifth as many independently controlled servo motors as there are needles in the transverse row comprising the steps of:

(a) feeding yarns from the yarn supply to the yarn feed mechanism;

(b) placing a group of at least two yarns in contact with a yarn feed roll in communication with an independently controlled servo motor;

(c) feeding the group of yarns out of the yarn feed mechanism and threading each yarn in the group through an adjacent needle in the transverse row;

(d) placing additional groups of at least two yarns on additional yarn feed rolls in communication with independently controlled servo motors and threading each yarn in each group to adjacent needles in the transverse row until the transverse width of threaded needles approaches the width of the backing fabric;

(e) feeding the backing fabric through the tufting machine while reciprocating the transverse row of needles, and operating the servo motors to feed yarn to the needles according to a predetermined pattern.

15. The method of claim 14 wherein the torque applied by the yarn feed rolls to the groups of contacting yarns is greater than the torque applied by the servo motors to the yarn feed rolls.

16. The method of claim 14 wherein each group of yarns consists of two yarns.

17. The method claim 14 wherein the independently controlled servo motors are aligned in rows of at least five motors extending longitudinally from the tufting machine parallel to the direction of the feed of the backing fabric.

18. The method of claim 17 in which each row of independently controlled servo motors is attached to a mounting surface of a support bar and a controller electronically receives information corresponding to the reciprocating position of the transverse needle row and electronically sends corresponding ratiometric pattern information to the servo motors.

19. The method of claim 14 wherein each group of yarns is threaded through a yarn guide prior to contacting the yarn feed roll.

20. The method of claim 14 wherein each group of yarns is threaded from the yarn feed roll to the needles without employing a tube bank to guide the yarns.

* * * * *